US011778396B2

(12) United States Patent
Mandala' et al.

(10) Patent No.: US 11,778,396 B2
(45) Date of Patent: Oct. 3, 2023

(54) ELECTROMECHANICAL STIMULATION SYSTEM FOR TREATING TINNITUS

(71) Applicants: UNIVERSITÀ DEGLI STUDI DI SIENA, Siena (IT); AZIENDA OSPEDALIERA UNIVERSITARIA SENESE, Siena (IT)

(72) Inventors: Marco Mandala', Poggibonsi (IT); Domenico Prattichizzo, Siena (IT); Simone Rossi, Siena (IT)

(73) Assignees: UNIVERSITÀ DEGLI STUDI DI SIENA, Siena (IT); AZIENDA OSPEDALIERA UNIVERSITARIA SENESE, Siena (IT)

( * ) Notice: Subject to any disclaimer, the term of this patent is extended or adjusted under 35 U.S.C. 154(b) by 440 days.

(21) Appl. No.: 16/641,625

(22) PCT Filed: Aug. 27, 2018

(86) PCT No.: PCT/IB2018/056523

§ 371 (c)(1),
(2) Date: Feb. 24, 2020

(87) PCT Pub. No.: WO2019/038746

PCT Pub. Date: Feb. 28, 2019

(65) Prior Publication Data

US 2021/0168545 A1 Jun. 3, 2021

(30) Foreign Application Priority Data

Aug. 25, 2017 (IT) ..... 102017000096334

(51) Int. Cl.
*H04R 25/00* (2006.01)

(52) U.S. Cl.
CPC ..... *H04R 25/75* (2013.01); *H04R 25/606* (2013.01); *H04R 2460/13* (2013.01)

(58) Field of Classification Search
CPC ... H04R 25/75; H04R 25/606; H04R 2460/13
See application file for complete search history.

(56) References Cited

U.S. PATENT DOCUMENTS 5,325,872 A 7/1994 Westermann
5,788,656 A 8/1998 Mino
(Continued)

FOREIGN PATENT DOCUMENTS

EP 3 184 046 A1 6/2017
EP 3184046 A1 * 6/2017 ..... A61B 5/128
(Continued)

OTHER PUBLICATIONS

Clark, John. (1981). Uses and abuses of hearing loss classification. ASHA. 23. 493-500. (Year: 1981).*
(Continued)

*Primary Examiner* — Thaddeus B Cox
*Assistant Examiner* — Marc D. Honrath
(74) *Attorney, Agent, or Firm* — Maschoff Brennan

(57) ABSTRACT

An electromechanical stimulation system for treating tinnitus comprising a proximal unit (10), configured to be placed proximate to a user's ear (1), and an input interface (50) configured to be operated by the user. The proximal unit comprises an electromechanical device (30) configured to transmit mechanical vibrations (35) with predetermined frequency (f), intensity (A) and waveform, to tissues proximate to the user's ear; a control unit (20), configured to actuate the electromechanical device in such a way that the frequency, the intensity and the waveform of the mechanical vibrations can be modified; a transceiver element (40) adapted to receive control signals (45) for the control unit. The input interface comprises a transmitter element (60) configured to transmit control signals (45) to the transceiver element; a microcontroller (70) configured to emit the
(Continued)

control signals to generate the mechanical vibrations of the electromechanical device at a first frequency between 20 Hz and 20 kHz, and to cause a repetition of the vibrations for all the plurality of frequencies of this range; an input element (80) configured to receive from the user an instruction to start generating said vibrations at a stationary frequency corresponding to a current frequency, to stand by, to receive from the user an instruction to stop modifying the frequency of said vibrations, such that said user can notify to said microcontroller (70) a frequency value at which he/she perceives a significant decrease of tinnitus symptoms; to continue generating mechanical vibrations at this stationary frequency.

12 Claims, 9 Drawing Sheets

(56) References Cited

U.S. PATENT DOCUMENTS

| | | | | |
|---|---|---|---|---|
| 6,077,215 | A | 6/2000 | Leysieffer | |
| 6,210,321 | B1 | 4/2001 | Di Mino et al. | |
| 2008/0064993 | A1* | 3/2008 | Abolfathi | H04R 25/75 601/47 |
| 2013/0163797 | A1* | 6/2013 | Suzman | A61B 5/128 381/314 |
| 2014/0064533 | A1* | 3/2014 | Kasic, II | H04R 25/60 381/329 |
| 2014/0121450 | A1* | 5/2014 | Kasic | H04R 25/60 600/25 |
| 2015/0164381 | A1* | 6/2015 | Rush | A61B 5/128 381/73.1 |
| 2016/0250440 | A1* | 9/2016 | Merz | A61B 5/6803 600/28 |
| 2016/0366527 | A1* | 12/2016 | Jones | H04R 25/75 |

FOREIGN PATENT DOCUMENTS

| | | | | |
|---|---|---|---|---|
| WO | 2015/020753 | A2 | 2/2015 | |
| WO | WO-2015020753 | A2 * | 2/2015 | H04R 25/60 |

OTHER PUBLICATIONS

Henry, Paula & Letowski, Tomasz. (2007). Bone conduction: Anatomy, physiology, and communication. 192. (Year: 2007).*

Dobie R. A., "A review of randomized clinical trials in tinnitus," The Laryngoscope, vol. 109, No. 8, pp. 1202-1211 (Sep. 1999).

* cited by examiner

ELECTROMECHANICAL STIMULATION SYSTEM FOR TREATING TINNITUS

FIELD OF THE INVENTION

The present invention relates to the medical field, and, more in detail, it relates to an electromechanical stimulation system for treating a subject suffering from tinnitus, or phantom noise.

More in particular, the invention relates to a device for non-invasively delivering such a treatment.

DESCRIPTION OF THE PRIOR ART

The phantom noise, or tinnitus, is a hearing disease that can disturb the correct perception of the sounds and, in particular, of the language. In fact, tinnitus is the perception of noises having various frequencies and intensities, which do not relate to any acoustic signal coming from the environment. These noises can be heard in one ear, in both ears or, more in general, as noises coming from within the head.

In particular, tinnitus can be heard as a single-frequency noise, for example a whistle, a clinking or the like, in which case it is called a tonal tinnitus, or it can be heard as a broadband noise, such as a swish, a buzzing, a whisper and the like, in which case it is called a non-tonal tinnitus. Tinnitus is extremely frequent, can have various intensities, and can even disturb the patient's daily activities and his/her sleep, and even cause serious cognitive and behavioural diseases, which can severely affect the subject's quality of life.

Tinnitus is commonly treated by audio devices that are configured to provide the user with tone-based therapies, whose effect is to mask the specific tinnitus frequency.

An example of this kind of device is disclosed in U.S. Pat. No. 5,325,872, and comprises a control unit to provide an audio signal at a transmission frequency that can be suitably adjusted within a predetermined range, until an optimum value is found which mitigates or masks the disease at best.

Surgically implantable devices are also known, as described in U.S. Pat. No. 6,077,215, in which the most inner ear part are stimulated by an electromechanical transducer implanted within the mastoid process. These devices are invasive, cause side effects and, in any case, have never turned out to be effective (Dobie R A. "A review of randomized clinical trials in tinnitus". Laryngoscope 1999, 109, 1202.1211).

U.S. Pat. No. 5,788,656 describes a further example of stimulation system comprising an electromagnetically operated electromechanical device to be positioned near the cochlea, in the inner ear. This electromechanical device can stimulate the cochlea in the tinnitus frequency range. In this case, a couple of oscillators working at a low and at a high frequency, respectively, within a range set between 400 Hz and 1000 Hz, provides a stimulation pilot signal. By this system, the user can customize the therapy to his/her own needs, by adjusting the vibration frequency of the actuation device.

Also this therapeutic system is invasive, and does not allow a stimulation therapy that is effective in mitigating or suppressing the disease in a middle-long term.

US 2008/0064993 A1 describes the use of a device comprising an electromechanical transducer that, if mounted to a mouth bone, such as a tooth or a palate bone, provides mechanical vibrations at a frequency and at an amplitude that can be adjusted. In particular, this device exploits the bone sound conduction, and can provide an acoustic signal that masks the tinnitus perception by superimposing mechanical vibrations to it, which cancels the effects of tinnitus, or by adding pleasant mechanical vibrations that divert the user's attention away from the tinnitus. However, US 2008/0064993 A1 does not indicate how to identify the frequencies that are suitable for cancelling the tinnitus, but only uses tables of values obtained by investigations made on a sample of patients, or carries out specific audiology tests for each user.

U.S. Pat. No. 6,210,321 B1 describes a further example of system for mitigating tinnitus, comprising a semi-rigid membrane, to be placed outside of the ear on the mastoid bone, close to the cochlea. The membrane is configured to be excited by an electric stimulation, and to transmit mechanical vibrations to the cochlea. In this case, the user can obtain a customized therapy by adjusting the frequency and intensity parameters of the stimulation. However, this adjustment is difficult and uncomfortable for the user.

Other devices for treating tinnitus are described in US 2015/164381 A1, US 2013/163797 A1, EP 3184046 A1, US 2016/250440 A1.

SUMMARY OF THE INVENTION

It is therefore a feature of the present invention to provide an electromechanical stimulation system for treating tinnitus, which provides a non-invasive, easily customizable therapy that is centred about the user's perceptions.

It is also a feature of the present invention to provide an electromechanical stimulation system for treating tinnitus that can be easily adjusted by therapist and by the user as well, so that a therapist's help is less required for a normal use of the system at home.

It is also a feature of the present invention to provide an electromechanical stimulation system for treating tinnitus that can be applied without surgical operation.

It is still a feature of the present invention to provide such a system that can adjusted by devices commonly available to the user.

These and other objects are achieved by an electromechanical stimulation system for treating tinnitus, comprising:

a proximal unit configured to be placed proximate to a user's ear, the proximal unit comprising:

an electromechanical device, configured to transmit mechanical vibrations to tissues near the user's ear or in any case to the user's skull, the mechanical vibrations having predetermined frequency, intensity and waveform;

an application device, configured to maintain the electromechanical device in contact with tissues corresponding to bone processes of the head selected among the temporal bone, in particular the mastoid process; the occipital bone; the frontal bone;

a control unit, configured to actuate the electromechanical device in such a way that the frequency, the intensity and the waveform of the mechanical vibrations can be modified;

a transceiver element configured to receive control signals for the control unit;

an input interface configured to be operated by the user, comprising:

a transmitter element configured to transmit control signals to the transceiver element of the proximal unit;

a microcontroller configured to emit said control signals towards said control unit for generating mechanical vibrations of said electromechanical device at a first frequency set within a range between 20 Hz and 20 kHz and at an intensity lower than a predetermined intensity limit value, and for causing a repetition of said mechanical vibrations for a plurality of frequencies within this range;

an input element configured to:

receiving from the user an instruction to start generating mechanical vibrations by said electromechanical device at a plurality of different frequencies, stand by while said mechanical vibrations at said different frequencies are generated;

receiving from said user a frequency scanning stop-instruction to stop modifying the frequency of the mechanical vibrations at a stationary frequency corresponding to the current frequency of the mechanical vibration being generated, so that the user can notify to the microcontroller a frequency value at which he/she perceives a decrease of the tinnitus symptoms;

continue generating mechanical vibrations at said stationary frequency.

This way, the application device, which is configured to maintain the electromechanical device in contact with tissues corresponding to bone processes of the head selected among the temporal bone, in particular the mastoid process, the occipital bone, the frontal bone, has the technical effect of causing the mechanical vibrations to be transmitted in the form of:

auditory stimulation by bone conduction;

vestibular stimulation by bone conduction;

tactile stimulation of the skin;

vibratory proprioceptive stimulation, thus obtaining a multisensorial stimulation. In fact, besides reaching the vestibular zone by bone conduction and mitigating tinnitus, a vibration delivered to the skin in a suitable way also provides, in a broader sense, a proprioceptive localization of the vibratory stimulation transmission zone.

Moreover, the system: tries the possible frequencies of such a multisensorial stimulation, accordingly generates the mechanical vibrations at all the frequencies set between 20 Hz and 20 kHz, in particular set between 125 Hz and 8000 Hz, said frequencies differing from each other for instance by 1 Hz, awaits the frequency scanning stop-instruction for the mechanical vibrations, which occurs when the user perceives a decrease or disappearance of the tinnitus symptoms, and maintains the frequency of the subsequent mechanical vibrations at the stationary frequency value. This solution allows to find each personally different stationary-frequency value at which, for each user, tinnitus disappears or decreases in intensity.

In comparison with US 2015/164381 A1, US 2013/163797 A1, EP 3184046 A1, US 2016/250440 A1, the present invention has the differences and the advantages described hereinafter.

In the invention, the multisensorial stimulations are used to mitigate/suppress tinnitus, by delivering mechanical vibrations to skin regions close to the temporal bone, and/or the occipital bone, and/or the frontal bone, at an intensity below a predetermined intensity threshold, which can be the patient's auditory threshold, or at an intensity slightly higher than the audibility threshold, as described hereinafter, in order to avoid any distortion or increase of the auditory perception and to promote a 24 hour application of the device, which would be uncomfortable and discouraging at a higher intensity. The multisensorial stimulations comprise the auditory stimulation by bone conduction, the vestibular stimulation by bone conduction, the tactile stimulation of the skin and the vibratory proprioceptive stimulation.

The vibrations of the electromechanical device, such as a voice coil actuator, have an intensity that is normally lower or slightly higher than the audibility threshold. However, the vibrations are not generated at an intensity lower than the tactile perception threshold, and provide therefore the user with a tactile sensation that triggers the proprioception, i.e., it makes the user aware of the region of the body where the electromechanical device is applied, and where the same delivers the vibrations to the skin. On the contrary, the vibrations of the prior art systems have an intensity far higher than the audibility threshold, since they are intended for causing the user to hear a sound that is in opposition of phase to the tinnitus symptoms, or that must cover the tinnitus symptoms. For this reason, in such prior art systems, the proprioception is shadowed by the emitted sound.

In the case of the invention, the patient substantially does not hear any sound coming from the electromechanical device, therefore the proprioception plays a most important role. In other words, the patient has a tactile perception of a slight vibration on his/her skin, localizes it (proprioception) and, at the same time, the vibration is transmitted to the head bones close the skin region where the vibration is delivered, i.e. it propagates by bone conduction, and finally reaches the auditory apparatus (vestibular stimulation). It is believed that the combination of the multisensorial stimulation with a specific optimum tinnitus-mitigating frequency, which is identified by the user, i.e. the combination of the two main characteristics of the invention distinguishing it from the prior art, makes it possible to obtain the therapeutic effect of suppressing the tinnitus symptoms.

Moreover, due to the frequency scanning performed during the stimulation by bone conduction, with the invention it is not necessary to determine or to know the features of the tinnitus symptoms, unlike the prior art treatments. In fact, it is the patient him/herself who directly selects the stimulation that is suitable for suppressing the tinnitus symptoms, even if the origin or the parameters characterizing the tinnitus symptoms are not known.

Above all, the advantage of the device consists in that it has been observed that if the patient, after a first vibration application time of a few hours, during which he/she receives mechanical vibrations at the stationary frequency which mitigates at best the tinnitus symptoms, stops the vibrations, the tinnitus symptoms are further mitigated during a first tinnitus silence time, and therefore can set the vibrations off for a vibration stand-by time. When the tinnitus symptoms begin again, the user has just to start a second vibration application step at the stationary frequency, therefore the vibration stand-by time is preferably selected equal to the tinnitus silence time, the second vibration application step is maintained for a second vibration time and is discontinued and maintained off until the tinnitus symptoms begins once again, after a second tinnitus silence time longer than the first tinnitus silence time, and so on. In fact, it has been observed that if the vibration time and the stand-by time are repeated with the device according to the invention, the tinnitus silence time always increases, which shows the therapeutic efficacy of the device.

Moreover, the system is particularly customizable and easy to use because the electromechanical device can transmit mechanical vibrations at different frequencies to tissues proximate to the user's ear, and the user can adjust these mechanical vibrations by an input interface.

In fact, the user can easily carry out therapeutic sessions according to his/her own needs by means of a personal mobile communication device provided with a touchscreen graphic display interface such as a smartphone, in which a mobile app is installed. Therefore, the user doesn't need any therapist's help.

As an alternative, the input element can be a PC, a smartwatch, a smart-TV or a tablet. In this case, the user can provide start and stop-instructions by a keyboard, by a remote control device, or even by a touch screen device.

Advantageously, the application device comprises a support configured to be mounted close to a bone of the user's skull, in particular selected among the temporal bone, the occipital bone and the frontal bone, where the skin layer is thinner, and outside of the ear, the support having a housing for receiving, in particular for removably receiving the electromechanical device. This way, the support allows a contact of the electromechanical device with the skin, so as to enable the above-mentioned four types of stimulation.

In particular, the application device includes an adhesive support, comprising:

an adhesive portion configured to be applied close to said bone of the skull;

a support portion comprising said housing for receiving the electromechanical device.

This way, as the electromechanical device is configured to be arranged at a bone region and out of the user's ear, no surgery operation is required to use the system. This makes it possible to eliminate the risks and the side effects inherent to surgical interventions. Moreover, as the electromechanical device is removable, it is not necessary to wear the support all the time. The support can be mounted to the patient, for instance, by an adhesive that stays attached to the skin for a few days, in particular, as long as required to perform the therapy, or in any case for a number of days so short to require few replacements of the adhesive support during the whole treatment, besides allowing not to wear the electromechanical device in the time between one therapy session and the subsequent session.

In particular, the electromechanical device is a voice coil type actuator, of small dimensions, comprising an output shaft that is free of moving axially, in which the mechanical force generated by the shaft is proportional to the current circulating in its own electric coil, and is therefore proportional to the intensity of the electric actuation signal produced by the control unit in the time unit.

This way, the frequency, the intensity and the waveform of the mechanical vibrations that are transmitted to the tissues proximate to the user's ear through the output shaft, can be modified, which enables the user to customize the therapy according to his/her own needs.

The system according to the invention, and, in particular, the voice coil actuator located on a temporal or occipital or front bone, makes it possible to deliver a multisensorial stimulation, in which the vibration is transmitted to the bone through the skin along two propagation paths, i.e. a first path through the bone tissue surrounding the area where the actuator is applied, and a second path through the fluids and the soft tissues of the vestibular region. Accordingly, due to the pulses applied to the skin, a tactile sensation triggers the patient's proprioceptive system that makes it possible to identify the area where the skin is stimulated. It is believed that the association of the multisensorial stimulation with the frequency scanning in order to find out the tinnitus-mitigating value, and the delivering of vibrations at that frequency, is the reason why the system according to the invention can more effectively cure the tinnitus disease.

As an alternative, the electromechanical device can be a voice coil type actuator comprising such a body as a membrane, which can vibrate due to the excitations caused by the current that circulates in a coil surrounding this body.

In a further exemplary embodiment, the electromechanical device can be a piezoelectric type actuator.

Advantageously, the microcontroller is configured to carry out a step of fine tuning the frequency of the mechanical vibrations, upon receiving a frequency scanning stop-instruction from the user.

In particular, after perceiving a tinnitus decrease for a given frequency, the user can interact with the input element by providing a frequency scanning stop-instruction at the frequency at which he/she has perceived a tinnitus decrease, i.e. at the above-mentioned stationary frequency, and then by finely scanning the frequencies in a neighbourhood of the stationary frequency, thus adjusting the frequency more finely than what was made by the stationary frequency, in order to further reduce or suppress the noise, without any external assistance and according to his/her own perceptions.

Advantageously, the microcontroller is configured to carry out an intensity adjustment of the mechanical vibrations upon receiving the frequency scanning stop-instruction at said stationary frequency.

This way, the signal intensity adjustment can improve the therapy by using an intensity value that is most suitable for treating tinnitus.

Advantageously, the microcontroller is configured to carry out an intensity adjustment of the mechanical vibrations at the end of the step of fine tuning the frequency.

This way, the user, after causing a first train of mechanical vibrations to be delivered at frequencies within a first range and then a second train of mechanical vibrations at frequencies within a second range, narrower than the first range, can perform a third adjustment of the signal intensity, so as to generate mechanical vibrations of the electromechanical device that can further reduce the perceived tinnitus symptoms.

As an alternative, the microcontroller can perform a step of fine tuning the intensity of the mechanical vibrations after receiving the scan stop-instruction and after the intensity adjustment of the mechanical vibrations.

An advantage of this solution is to provide a stimulation even more targeted to the subject's needs. For instance, a user who has obtained a satisfactory tinnitus symptoms reduction by the frequency adjustment or by the frequency fine tuning, can perform an intensity fine tuning step after the scan stop-instruction, which makes the stimulation system even more targeted to his/her needs.

Advantageously, the microcontroller is configured to modify the intensity of the mechanical vibrations when the user has not perceived any tinnitus decrease at the end of the step of adjusting the frequency of the mechanical vibrations, i.e. after scanning all the frequencies within the predetermined scanning/adjusting range. In particular, the stimulation used is weaker than the user's auditory threshold or has an intensity level that cannot disturb the subject's hearing during his/her ordinary activities.

This way, the user, after performing the frequency adjustment step, can decide to modify the intensity of the stimulation signal, and carry out a new frequency adjustment step by causing mechanical vibrations at a new intensity to be generated.

In particular the microcontroller is configured to cause the mechanical vibrations emitted by the electromechanical device within an intensity range between −20 dB HL and 20 dB HL.

In particular, the intensity limit value below which the microcontroller is configured to modify the intensity of the mechanical vibrations is equal to the user's auditory threshold, in other words, the microcontroller is configured to cause the mechanical vibrations to be emitted by the electromechanical device at an intensity lower than or equal to the audibility threshold.

In particular, the intensity limit value below which the microcontroller is configured to modify the intensity of the mechanical vibrations can be equal to the user's auditory threshold increased by 10% in dB HL. More in detail, the microcontroller is configured to cause the electromechanical device to emit the mechanical vibrations at an intensity at most 10% higher than an audibility threshold, during an acclimation time after the instruction to start generating the mechanical vibrations, in order to enable the user to feel the generated vibrations as acoustic vibrations, and is also configured to reduce the intensity to a value lower than the audibility threshold, once the acclimation time has elapsed.

Advantageously, the electromechanical device is programmed for automatically transmitting mechanical vibrations at predetermined time intervals.

This way, customized stimulation therapeutic programs can be obtained in which, for instance, a mechanical vibrations delivery is provided at predetermined frequencies for predetermined periods of time. For example, if after a time during which the device is off the user realizes that the tinnitus symptoms has disappeared, the stand-by time of the device can be extended, or shortened if, on the contrary, tinnitus occurs again before the stand-by time has elapsed.

Advantageously, the microcontroller is configured to carry out a step of adjusting the waveform of the mechanical vibrations. This adjustment can be provided when the user has not experienced any relief during the frequency scanning with a given vibration waveform, and can therefore repeat the scanning for a different waveform.

This way, by the stimulation system according to the invention, the user can provide mechanical stimulations widely differentiated, in order to obtain a decrease of the tinnitus symptoms.

BRIEF DESCRIPTION OF THE DRAWINGS

Further characteristic and/or advantages of the present invention will be made clearer with the following description of an exemplary embodiment thereof, and its exemplary embodiments, exemplifying but not limitative, with reference to the attached drawings in which.

DESCRIPTION OF SOME PREFERRED EXEMPLARY EMBODIMENTS

Figure 1:
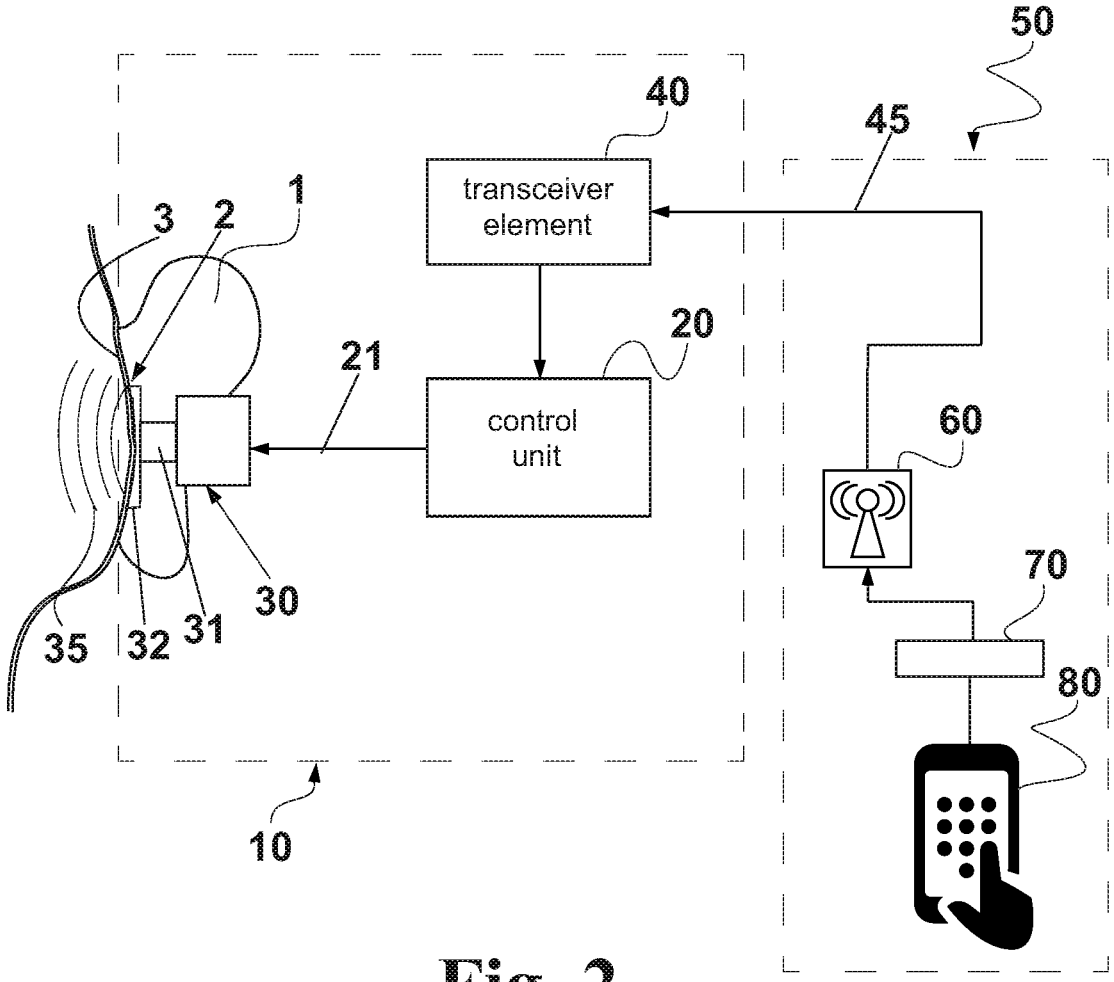
FIG. 1 diagrammatically shows an example of an electromechanical stimulation system for treating tinnitus, according to the invention, comprising a proximal unit and an input interface that are in communication with each other, for delivering mechanical vibrations to tissues proximate to a user's ear.

FIG. 1 shows a possible exemplary embodiment of an electromechanical stimulation system for treating tinnitus. The system comprises a proximal unit 10, configured to be positioned near a user's ear 1, and an input interface 50 configured to be operated by the user, in order to communicate with proximal unit 10.

In the shown example, proximal unit 10 is located in a zone close to a mastoid process, but it can be located on both mastoid processes or on the user's forehead.

Proximal unit 10 comprises an electromechanical device 30, an application device 32 thereof, a control unit 20 and a transceiver element 40 configured to receive control signals 45 for control unit 20.

In particular, control unit 20 is a hardware component configured to generate an actuation signal 21 for electromechanical device 30, responsive to control signals 45 transmitted by transceiver element 40. The frequency f and the intensity A of actuation signal 21 can be modified, and the signal can have various waveforms. This makes it possible to use different parameters of frequency f, intensity A, and different waveforms of mechanical vibrations 35 emitted by electromechanical device 30 for each patient. Control unit 20 also allows combining particular values of such parameters of actuation signal 21, for which the user perceives a stop or a decrease of tinnitus.

For instance, control unit 20 can be a microcontroller including a CPU, in which operating instructions can be resident to generate actuation signals 21,45 to be transferred to electromechanical device 30, so that control unit 20 can autonomously send actuation signals 21 to electromechanical device 30. As an alternative, control unit 20 can have a library of actuation signals 21 that are different from each other and can be generated by transmitting control signals 45 from input interface 50. In particular, control unit 20 can be implemented by an Arduino platform including a microprocessor.

Electromechanical device can be a voice coil-type actuator 30 including an axially movable output shaft 31, in which the mechanical force generated by shaft 31 is proportional to the current circulating in an electric coil thereof, and so to the intensity of electric actuation signal 21 provided by control unit 20 in the time unit. According to an exemplary embodiment, not shown, electromechanical device 30 can still be a voice coil-type actuator that also includes a membrane, besides shaft 31, said membrane free to vibrate responsive to the excitation caused by the current circulating in the actuator coil. In a further exemplary embodiment, not shown, electromechanical device 30 can be a piezoelectric actuator.

Electromechanical device 30 is configured to deliver mechanical vibrations 35 to tissues near user's ear 1, through a movable element, for example shaft 31 or the membrane of the voice coil actuator, which delivers mechanical vibrations 35 to tissues 2 close to user's ear 1. Frequency f, intensity A and the waveform of mechanical vibrations 35 can be adjusted, so that the user can customize the therapy according to his/her own needs.

Application device 32 is configured to maintain electromechanical device 30, in particular also the whole proximal unit 10, in contact with external tissues like skin 2 at a protruding bone 3 of the head, for example the temporal bone, in particular the mastoid process or mastoid apophysis 3, the occipital bone or even the frontal bone, the last not shown. In particular, application device 32 comprises a support configured to be mounted at above-indicated protruding bone 3, and has a housing for receiving electromechanical device 30, preferably in a removable way. The support can have an adhesive portion to be attached to skin 2 and a support portion, which can be removable from the adhesive portion comprising the housing for receiving electromechanical device 30. This application device is configured in such a way that the force required for removing electromechanical device 30 from the support portion and/or the support portion from the adhesive portion is weaker than the force required for detaching the adhesive portion from patient's skin 2. No detailed description is given of this device, since it can be easily implemented by a skilled person.

Input interface 50 comprises a transmitter element 60, a microcontroller 70 and an input element 80.

Microcontroller 70 configured to actuate the generation of mechanical vibrations 35 having a plurality of frequencies f set in a predetermined range, by emitting actuation signal 45. More in detail, actuation signal 21,45 is configured to cause the actuation of electromechanical device 30 by control unit 20 at a predetermined frequency f set between 20 Hz and 20 kHz, in particular in such a narrower range as 125 Hz+8000 Hz. Microcontroller 70 can also cause the plurality of frequencies of this range to be repeated as actuation frequencies Input element 80 is configured to receive instructions from the user, in particular an instruction to start a step 200 (FIGS. 3-8) of delivering mechanical vibrations, said instruction also triggering a step 121 of modifying or adjusting frequency f of mechanical vibrations 35, which consists in modifying this parameter starting from a predetermined value. Input element 80 is also configured to stand by and receive from the user a frequency scanning stop-instruction 300 of frequency adjustment step 121, when the user perceives a significant decrease or a stop of tinnitus symptoms, and is also configured to continue generating vibrations 35 for a predetermined time while keeping unchanged the frequency at the value used when the frequency scanning stop-instruction has been inputted, when the step of adjusting frequency f of mechanical vibrations 35 is discontinued.

Other start/stop-instructions can be transmitted by input element 80, as it will be explained when describing some exemplary embodiments of the system, with reference to FIGS. 3-8.

Microcontroller 70 can be integrated with input element 80 in a same device. For instance, input element 80 can be a smartphone, a tablet, a PC, a smart-TV, or a smartwatch. In these cases, microcontroller 70 defines a "mobile app" that can be run in input element 80 where it is installed. As an alternative, input element 80 can be a PC. In this case, microcontroller 70 defines a software program installed in the PC.

Transmitter element 60, which is arranged to transmit control signals 45 generated by microcontroller 70 to transceiver element 40, can be a Bluetooth antenna that is present inside or outside of input element 80.

As an alternative, in other exemplary embodiments, not shown, the transmission of control signals 45 from interface/inlet element 50,80 to the proximal unit can occur in a different way, for example it can be a cable transmission.

Figure 2:
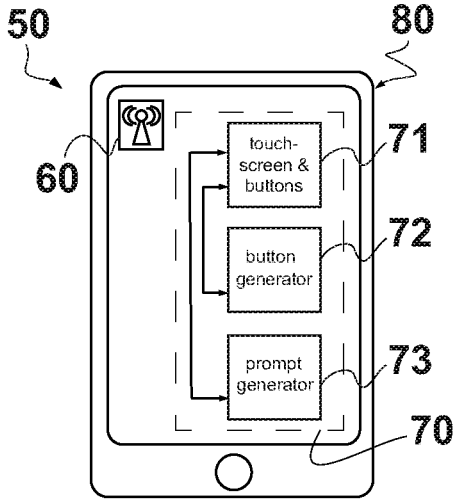
FIG. 2 shows a flow diagram, according to the invention, of virtual devices for controlling the interface of the microcontroller of the input interface and installed in an input element.

FIG. 2 shows a possible flow diagram in which virtual devices 71, 72, 73 are configured to control the interface of microcontroller 70 of input interface 50 and are installed in input element 80. In particular, in the example of FIG. 2, input element 80 is a personal mobile communication device, for example one selected among the above-indicated types, in which the graphic interface is controlled by three main virtual units, i.e. a prompt generator 73, a button generator 72, and a virtual touchscreen device 71. In this case, transmitter element 60 for transmitting the control signals is a Bluetooth antenna also incorporated in input element 80.

Figure 2A:
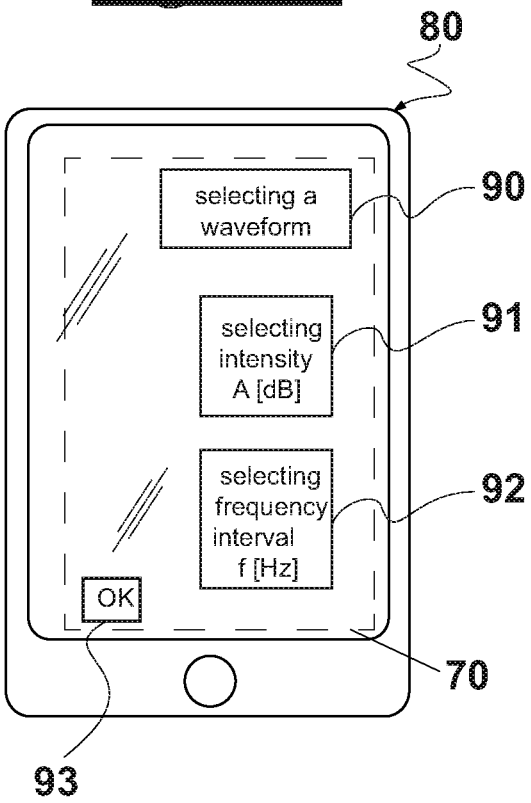
FIGS. 2A, 2B, 2C show examples of interface screens of the microcontroller, according to the invention, which are available in an input element.

FIG. 2A shows an example of interface screen of microcontroller 70, which defines a "mobile app" installed in input element 80, typically if the latter is a personal mobile communication device.

After installing the application in input element 80, the user can select the parameters of waveform 90, intensity 91 and frequency range 92 with which/within which mechanical vibrations 35 must be generated. An operation confirmation step 93 allows the user to view a subsequent screen, FIG. 2B, and to provide instructions of starting generating and delivering mechanical vibrations 35, and of adjusting at least the frequency of these mechanical vibrations through a start button 100. As anticipated, and as it will be better described hereinafter, the user can stop step 121 of adjusting the frequency through a stop button 101 of the screen, in particular, if he/she perceives a decrease of tinnitus symptoms.

Figure 2B:
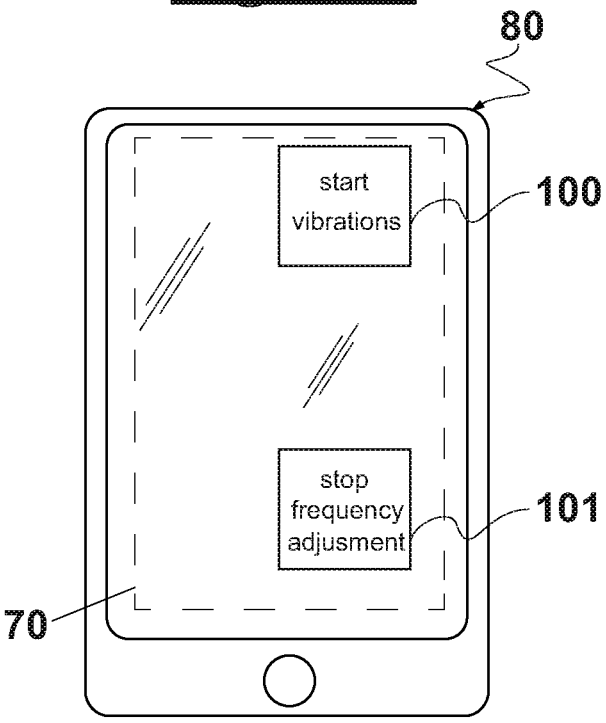
Figure 2C:
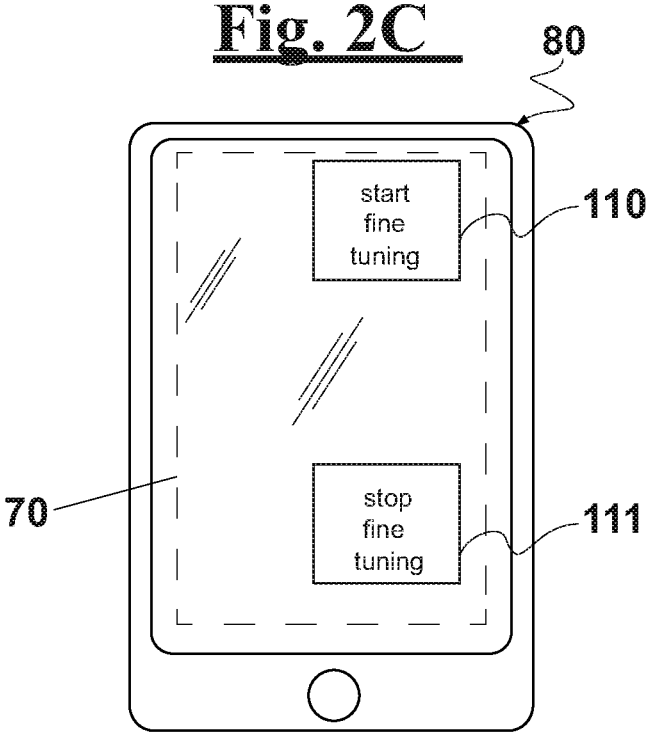

FIG. 2C shows an exemplary interface screen of microcontroller 70, which follows that of FIG. 2B, in an exemplary embodiment of the system described hereinafter. After frequency scanning stop-instruction 101, this screen enables the operator to input a command 110 of starting a step of fine tuning frequency f of actuation signal 45 and a step 111 of stopping the fine tuning step.

Figure 3:
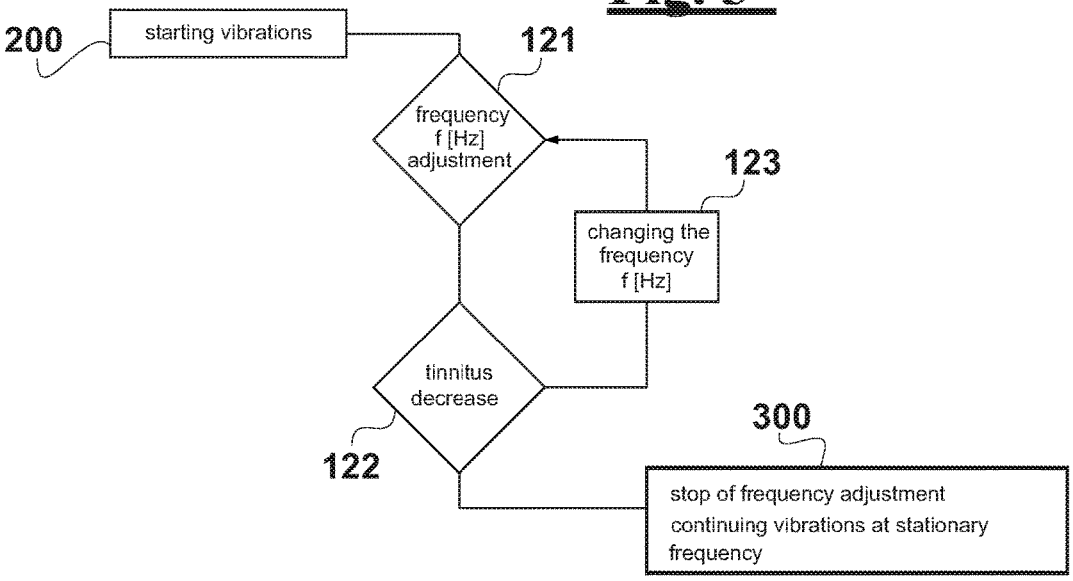
FIG. 3 shows an exemplary flow diagram of the microcontroller, according to the invention, to generate mechanical vibrations at frequencies variable in a predetermined range.

FIG. 3 shows a flow diagram of the operation of microcontroller 70 for generating mechanical vibrations 35. A user's instruction causes a step 200 of generating mechanical vibrations 35 and, at the same time, a step 121 of adjusting frequency f to start.

The step of adjusting frequency f of mechanical vibrations 35 provides a step of modifying the frequency of vibrations 35 that are being delivered while scanning a predetermined frequency f range, at predetermined time intervals, which can be selected by the user.

If a decrease 122 of tinnitus is perceived by the user, he/she can input a frequency scanning stop-instruction through input element 80. This event causes an interruption 300 of frequency scanning 121 at a frequency value at which mechanical vibrations 35 were being delivered when the stop-instruction has been inputted, and the stimulation, i.e. the delivering of vibrations 35, continues at a fixed frequency value equal to the tinnitus-mitigating frequency, which is identified as described above.

On the contrary, if the user does not perceive any significant decrease 122 of tinnitus, in the absence of the frequency scanning stop-instruction, the delivering of mechanical vibrations 35 continues with a step 123 of changing of the frequency range to be scanned, and with a new step 121 of adjusting the frequency, where frequency f is modified within a frequency range different from the range scanned before. The step proceeds this way, with different steps 121 of adjusting the frequency, as long as the user does not perceive any significant decrease 122 of tinnitus.

Figure 4:
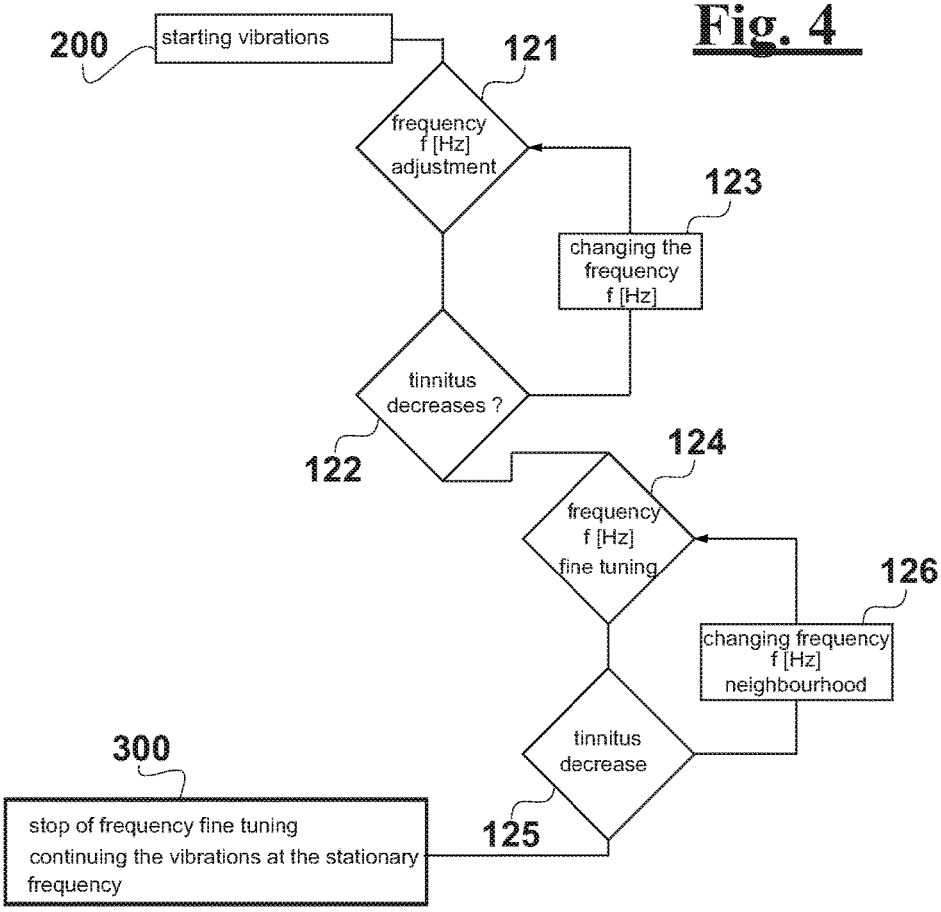
FIG. 4 shows an exemplary flow diagram of the microcontroller, according to the invention, similar to that of FIG. 3, including a step of fine tuning the frequency of the mechanical vibrations.

FIG. 4 shows a flow diagram of the operation of microcontroller 70, similar to that of FIG. 3, of an exemplary embodiment of the system in which a step 124 is further provided of fine tuning frequency f of actuation signal 45 and, therefore, of mechanical vibrations 35 being delivered.

In this case, in the absence of a frequency scanning stop-instruction for step 121 of adjusting the frequency, microcontroller 70 proceeds in the same way as in FIG. 3 by a step 123 of changing the frequency range to be scanned, and with a new generation of mechanical vibrations 35, along with step 121 of adjusting frequency f by scanning a different frequency range.

On the contrary, if the user, while mechanical vibrations 35 are being delivered at frequency f set in a given range, perceives a significant decrease 122 of tinnitus, he/she can notify this event to microcontroller 70, which performs a step 124 of fine tuning frequency f. In other words, microcontroller 70 narrows the frequency range to be scanned while delivering the subsequent mechanical vibrations 35, i.e. it selects a new frequency f range that is a neighbourhood of the frequency value at which the tinnitus decrease has been perceived and notified, and proceeds with a new step of adjusting, this time a step of fine tuning, frequency f, causing the latter to scan this neighbourhood.

If a further decrease 125 of tinnitus is perceived by the user, the latter can provide a frequency scanning stop-instruction for the step of fine tuning, in order to cause a stop 300 of the frequency fine tuning 124 at the value at which mechanical vibrations 35 were being delivered when this scan stop-instruction has been inputted, and the stimulation, i.e. the delivering of vibrations 35, continues at a fixed frequency value equal to further tinnitus-mitigating frequency, which is identified as described above.

On the contrary, if the user does not perceive any further significant decrease 125 of tinnitus, in the absence of the frequency scanning stop-instruction for the fine tuning step, the delivering of mechanical vibrations 35 continues with a step 126 of changing the frequency neighbourhood to be scanned as a new neighbourhood of the value that has caused the previous decrease, and with a step 124 of fine tuning frequency f by scanning this new neighbourhood. The step proceeds this way, with new steps of frequency fine tuning 124, as long as the user does not perceive any significant decrease 125 of tinnitus.

This way, the user can more precisely define the frequency at which a further decrease 125 of tinnitus symptoms occurs, i.e. he/she can check the frequency or the frequencies closest to the phantom noise frequency, thus improving the decrease thereof.

Figure 5:
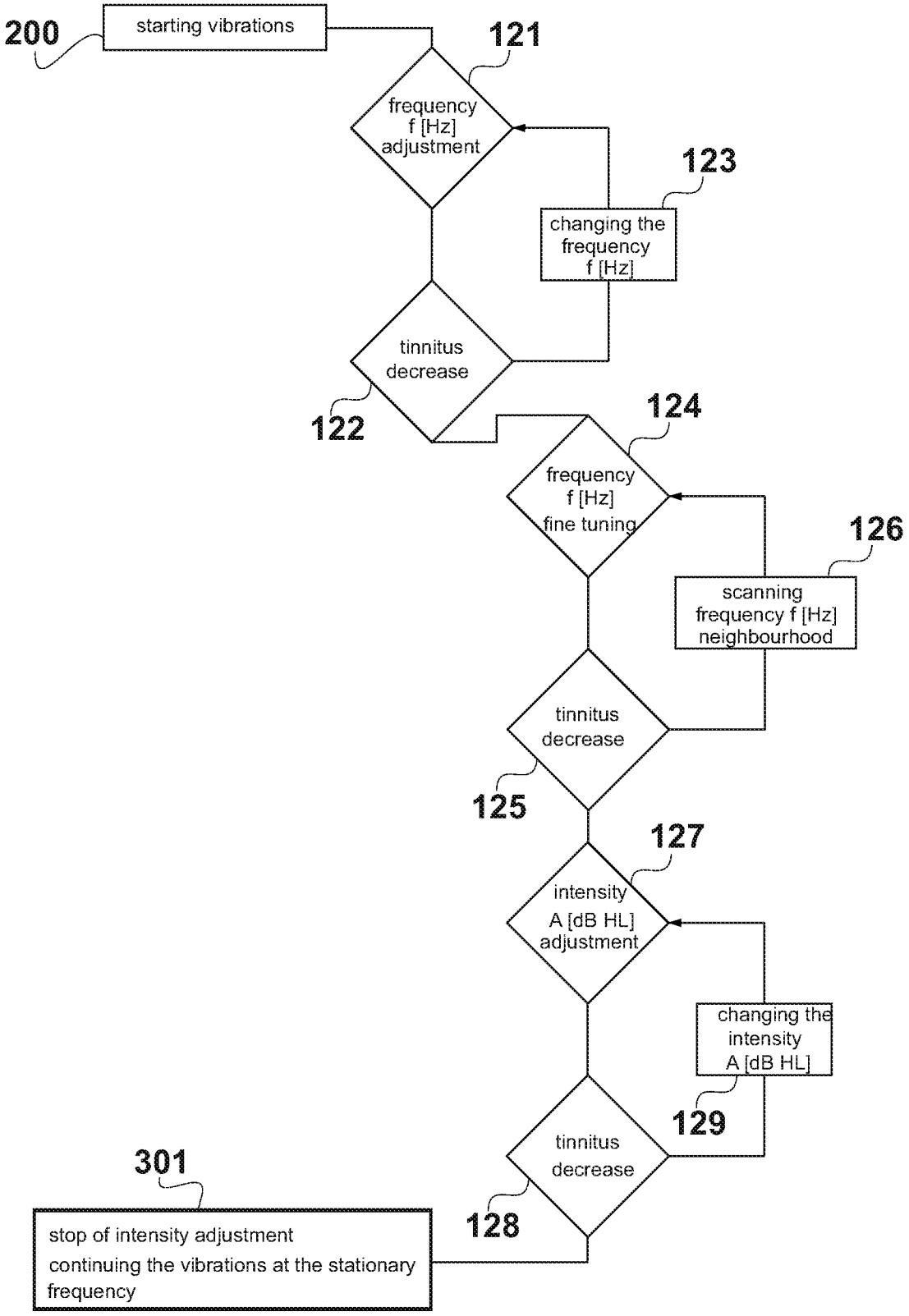
FIG. 5 shows an exemplary flow diagram of the microcontroller, according to the invention, similar to that of FIG. 4, including a step of adjusting the intensity of the mechanical vibrations.

FIG. 5 shows a flow diagram of the operation of microcontroller 70, similar to that of FIG. 4, in an exemplary embodiment of the system in which a step 127 is further provided of adjusting the intensity of actuation signal 45 and, therefore, of mechanical vibrations 35 being delivered.

In the absence of a frequency scanning stop-instruction, microcontroller 70 proceeds in the same way as in FIG. 4.

On the contrary, if the user, while mechanical vibrations 35 are being delivered at frequency f set in a given neighbourhood of a tinnitus-mitigating value, perceives a further decrease thereof, he/she can notify this event to microcontroller 70, which performs a step 127 of adjusting the intensity of actuation signal 45 and, therefore, of mechanical vibrations 35 being delivered. This step 127 of adjusting the intensity A of mechanical vibrations 35 provides a step of modifying intensity A of vibrations 35 being delivered by scanning an intensity A predetermined range, according to predetermined increase and decrease amounts, which can be selected by the user.

If a further decrease 128 of tinnitus is perceived by the user, the latter can provide an intensity scan stop-instruction in order to cause a stop 301 of the adjustment 127 of intensity A at the value at which mechanical vibrations 35 were being delivered when this scan stop-instruction has been inputted, and the stimulation, i.e. the delivering of vibrations 35, continues at a fixed intensity value equal to the tinnitus-mitigating intensity, which is identified as described above.

On the contrary, if the user does not perceive any further significant decrease 128 of tinnitus, in the absence of the intensity scan stop-instruction, the delivering of mechanical vibrations 35 continues with a step 129 of changing of intensity A range to be scanned, and with a new step 127 of adjusting the intensity, in which intensity A is modified within an intensity range different from the range scanned before. The step proceeds this way, with steps 127 of adjusting the intensity, as long as the user does not perceive any further significant decrease 128 of tinnitus.

Figure 6:
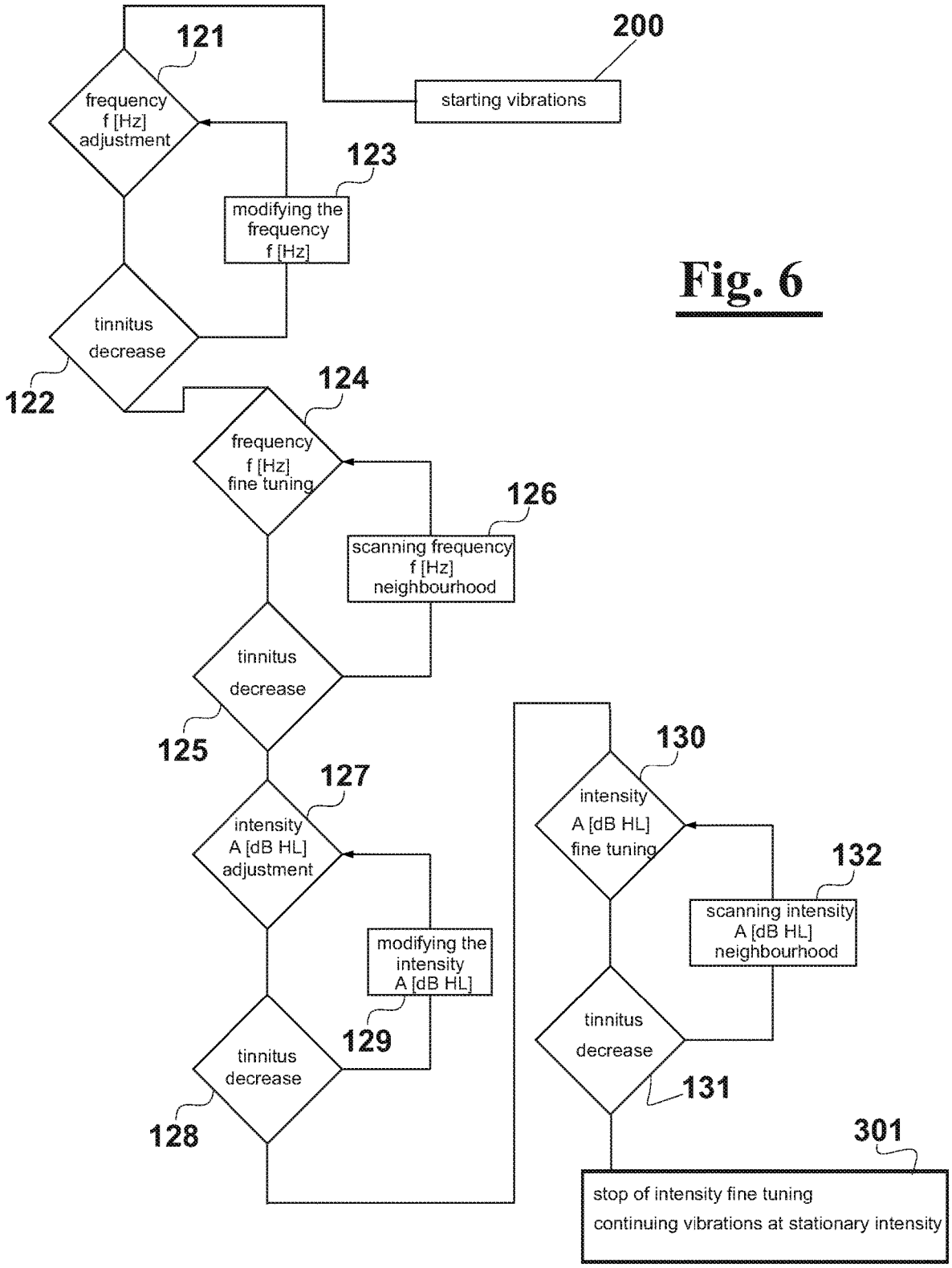
FIG. 6 shows an exemplary flow diagram of the microcontroller, according to the invention, similar to that of FIG. 5, including a step of fine tuning the intensity.

FIG. 6 shows a flow-sheet of the operation of microcontroller 70, similar to that of FIG. 5, in an exemplary embodiment of the system in which a step 130 is further provided of fine tuning the intensity of actuation signal 45 and, therefore, of mechanical vibrations 35 being delivered.

In this case, in the absence of an intensity scan stop-instruction for step 127 of adjusting intensity A, microcontroller 70 proceeds in the same way as in FIG. 5.

On the contrary, if the user, while mechanical vibrations 35 are being delivered at intensity A set in a given range, perceives a significant decrease 128 of tinnitus, he/she can notify this event to microcontroller 70, which performs a step 130 of fine tuning intensity A. In other words, microcontroller 70 narrows the intensity range to be scanned while delivering the subsequent mechanical vibrations 35, i.e. it selects an intensity range that is a neighbourhood of the intensity value A at which the tinnitus symptoms decrease has been perceived and notified, and proceeds with a step of adjusting, this time a step of fine tuning, intensity A, causing the latter to scan this neighbourhood.

If a further decrease 131 of tinnitus is perceived by the user, the latter can provide an intensity scan stop-instruction for the step of fine tuning in order to cause a stop 301 of the intensity fine tuning 130 at the value at which mechanical vibrations 35 were being delivered when this scan stop-instruction has been inputted, and the stimulation, i.e. the delivering of vibrations 35, continues at a fixed intensity value equal to the further tinnitus-mitigating intensity, which is identified as described above.

On the contrary, if the user does not perceive any further significant decrease 131 of tinnitus, in the absence of the intensity scan stop-instruction for the intensity fine tuning step, the generation of mechanical vibrations 35 continues with a step 132 of changing the intensity A range to be scanned as a new neighbourhood of the value that has caused the previous decrease, and with a step 130 of fine tuning intensity A by scanning this new neighbourhood. The step proceeds this way, with new steps of intensity fine tuning 130, as long as the user does not perceive any significant decrease 131 of tinnitus.

In an exemplary embodiment of the system, which is not shown in the diagrams described above but can be easily derived therefrom, a step can be provided of adjusting or scanning intensity A, and preferably also the step of fine tuning, i.e. finely adjusting intensity A, without carrying out the step of fine tuning or finely adjusting the frequency of actuation signal 45 and, therefore, of mechanical vibrations 35.

Figure 7:
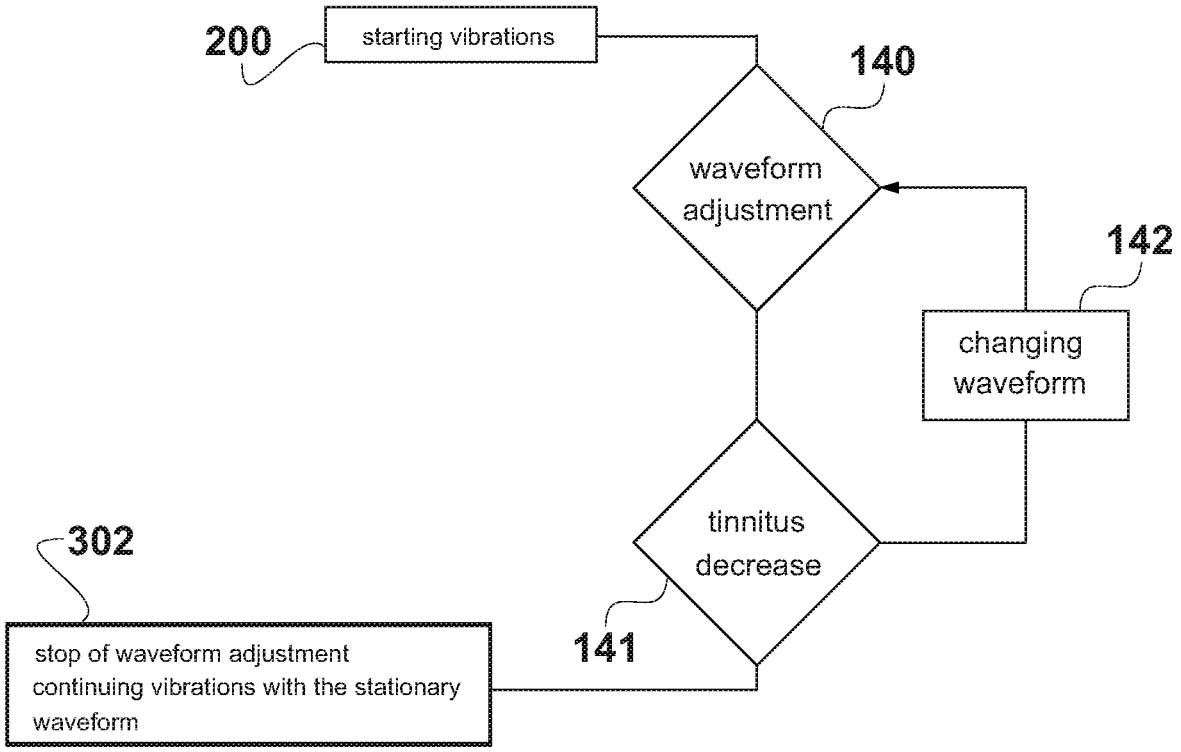
FIG. 7 shows an exemplary flow diagram of the microcontroller, according to the invention, including a step of adjusting the waveform of the mechanical vibrations.

FIG. 7 shows a flow diagram of the operation of microcontroller 70, in an exemplary embodiment of the system including a step 140 of adjusting the waveform of actuation signal 45 and, therefore, of mechanical vibrations 35. In this case, a user's instruction triggers a step 200 of generating mechanical vibrations 35, which starts at the same time as the frequency-adjusting step and includes a step of scanning a predetermined frequency f range, which can be selected by the user. Before this frequency adjustment, or at each frequency scanning stage, microcontroller 70 can carry out the waveform adjustment step 140 by selecting the waveform from a predetermined library that is resident in input interface 50, in order to generate the mechanical vibrations. In the former case, more in detail, if the user does not perceive any significant decrease 141 of tinnitus, a step 142 is provided of changing the waveform type, until the desired effect of tinnitus decrease 141 is obtained. Then, the user can notify this event to microcontroller 70 by providing a waveform adjustment scan stop-instruction in order to cause a stop 302 of the step 140 of scanning the waveform types at the type with which mechanical vibrations 35 were being delivered when this stop-instruction has been inputted, and the stimulation, i.e. the delivering of vibrations 35 continues with this waveform type.

Figure 8:
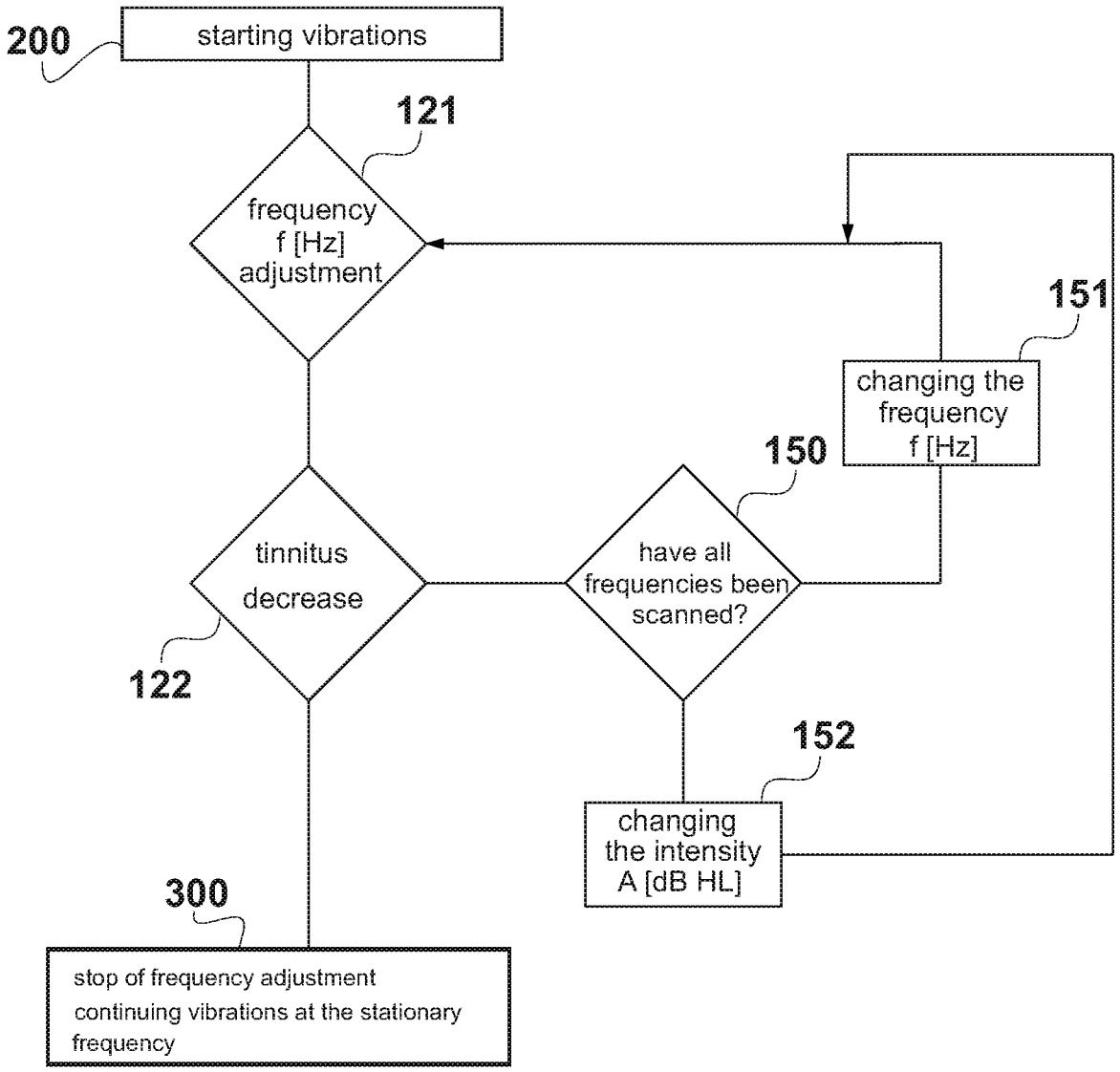
FIG. 8 shows an exemplary flow diagram of the microcontroller, according to the invention, including a step of changing the intensity of the mechanical vibrations if, at the end of the step of adjusting the frequency, the user has not perceived any decrease of the tinnitus symptoms.

The diagram of FIG. 8 relates to a modification of the system in which the possibility is provided of changing the intensity of actuation signal 45 and, therefore, of mechanical vibrations 35, if, after generating mechanical vibrations 35 and after modifying the frequency thereof by fully scanning a predetermined frequency range, the user has not perceived any significant decrease of the tinnitus symptoms. In this case, if no decrease 122 of the tinnitus symptoms is obtained after providing an instruction to start the step 200 of generating mechanical vibrations 35 and the contemporary step 121 of adjusting their frequency, the user can cause a change 152 the intensity of the signal and allow generation 200 of mechanical vibrations 35 to go on by starting a new frequency adjustment step 121 using the new value of the intensity, and then he/she can stop this frequency adjustment of mechanical vibrations 35 by providing a frequency scanning stop-instruction, upon perceiving a significant decrease 122 of tinnitus. If, after a first step 121 of adjusting the frequency of mechanical vibrations 35, the user does not perceive any significant decrease of tinnitus and if a check step 150 detects that the frequency range has not been fully scanned, a step 151 is provided of changing the frequency f range of mechanical vibrations 35.

In particular, microcontroller 70 is configured to deliver vibrations 35 at an intensity lower than the patient's auditory threshold. In an exemplary embodiment, not shown, a step of acclimation is provided at the beginning of the step 200 of delivering mechanical vibrations, i.e. immediately after receiving the start-instruction therefor, and microcontroller 70 is configured to deliver vibrations 35 having an intensity higher by at most 10,% than the absolute value in dB HL of patient's auditory threshold, in order to help the patient to identify mechanical vibrations 35 generated by electromechanical device 30.

Figure 9:
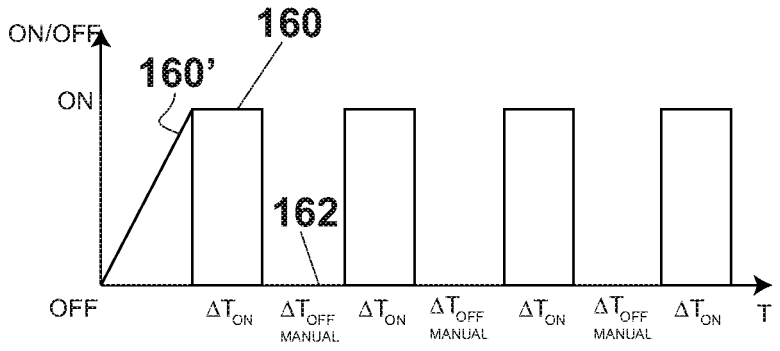
FIG. 9 shows a time operation diagram of an electromechanical device in manual operation mode.

FIG. 9 is a diagram showing the delivery times ON and the stand-by times OFF of electromechanical device 30, in a manual operation mode. More in detail, delivery time intervals 160 (ΔTON), 160' are defined, as well as stand-by time intervals 162 (ΔTOFF MANUAL) of electromechanical device 30, which the user can select according to his/her own needs by providing instructions through input element 80.

Figure 9A:
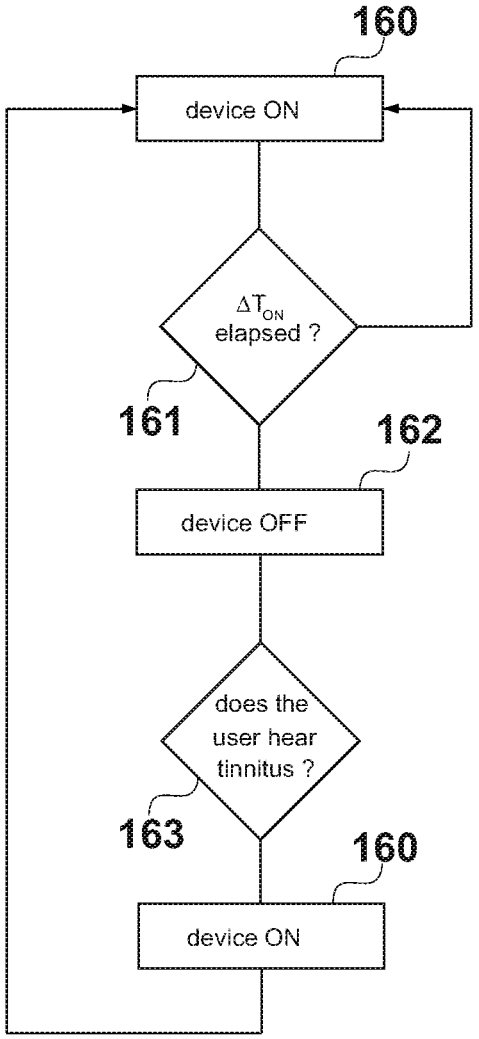
FIG. 9A shows an exemplary flow diagram to actuate the diagram of FIG. 9.

FIG. 9A is an example of a flow diagram for the operation of electromechanical device 30 in manual operation mode, according to FIG. 9. In this mode, the user provides switch-on instructions 160 and switch-off instructions 162 based on his/her perception of tinnitus symptoms 163, and according to delivery time intervals 160 based on his/her own perceptions.

Figure 10:
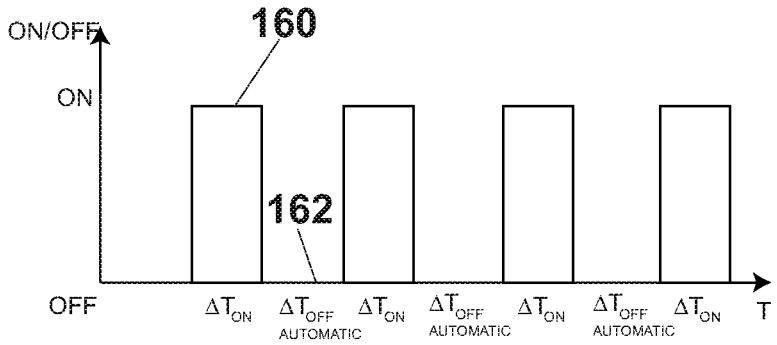
FIG. 10 shows a time operation diagram of an electromechanical device in automatic operation mode.

Instead, FIG. 10 is a diagram showing delivery values ON and stand-by values OFF of electromechanical device 30 in an automatic operation mode. In particular, electromechanical device 30 can be programmed for automatically transmitting mechanical vibrations 35 at predetermined time intervals, providing both time intervals 160 or ATON during which electromechanical device 30 is working and delivering stimulations at frequency f, intensity A and with a predetermined waveform, as well as stand-by time intervals 162 during which electromechanical device 30 is not working, i.e. stand-by time intervals can be defined (ΔTOFF AUTOMATIC).

In particular, in the automatic operation mode, customized therapeutic stimulation programs can be obtained, in which mechanical vibrations 35 are delivered at frequencies f, intensities A and with predetermined waveforms for predetermined periods of time, which alternate with stand-by steps. In particular, if the user perceives a significant decrease or a stop of tinnitus symptoms after a predetermined time interval in which the device is inactive, the stand-by times of the device can be prolonged, or they can be shortened, if, on the contrary, tinnitus occurs again during one of these stand-by periods.

Figure 10A:
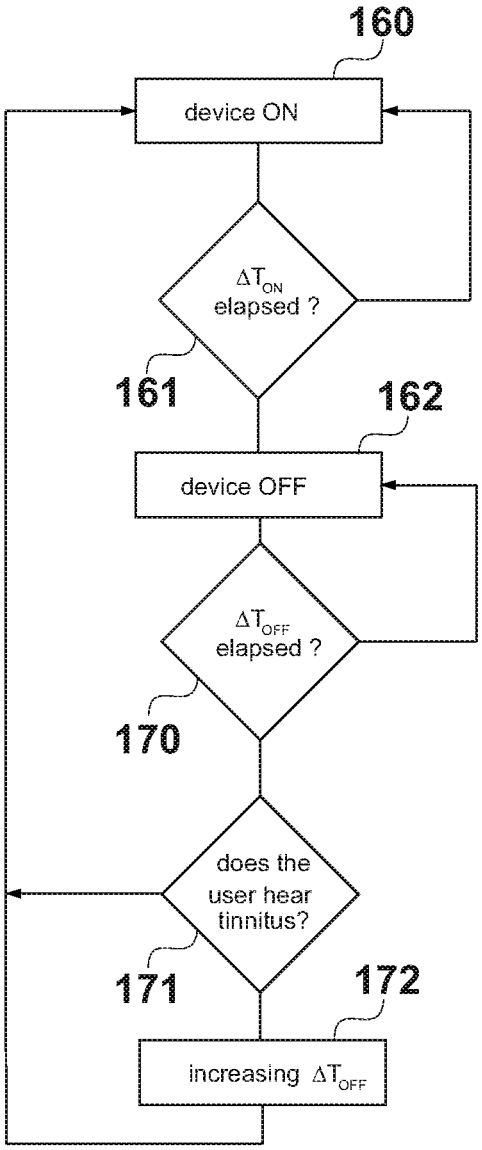
FIG. 10A shows an exemplary flow diagram to actuate the diagram of FIG. 10.

FIG. 10A shows a flow diagram for the operation of electromechanical device 30 in an automatic operation mode. During a time interval 160 of delivering mechanical vibrations, in which electromechanical device 30 is on, the system counts the time 161 elapsed after the beginning of this interval, and if this time exceeds a prefixed delivery time threshold, a stand-by step 162 of electromechanical device 30 begins. In the opposite case, electromechanical device 30 continues the delivering step 160. The stand-by step 162 of electromechanical device 30 continues until OFF mode time 170 exceeds a programmed duration. Before activating electromechanical device 30 again, in order to begin a new delivering step, an interrogation step 171 is provided, in which the user is asked whether he/she is still hearing the tinnitus symptoms. If that is the case, a new delivery step 160 step begins, whereas, if tinnitus disappears, a step 172 takes place of prolonging the stand-by times.

The foregoing description of some exemplary specific embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. An electromechanical stimulation system for treating tinnitus comprising:

a proximal unit configured to be placed on tissues of a user's skull which correspond to bones of the user's skull selected among the temporal bone; the occipital bone; the frontal bone, said proximal unit comprising:

an electromechanical vibrator configured to transmit mechanical vibrations having predetermined frequency, intensity and waveform, to said tissues;

an adhesive application device configured to maintain the electromechanical vibrator in contact with said tissues;

a control unit configured to actuate said electromechanical vibrator in such a way that said frequency, said intensity and said waveform of said mechanical vibrations can be modified; and said proximal unit configured to receive control signals for said control unit; and an electronic device configured to be operated by said user and comprising:

an electromagnetic transmitter configured to transmit control signals to said proximal unit;

a microcontroller configured to emit said control signals towards said control unit for generating mechanical vibrations of said electromechanical vibrator at a first frequency set within a range between 20 Hz and 20 kHz and at an intensity lower than a predetermined intensity limit value, and for causing a repetition of said mechanical vibrations at a plurality of frequencies within said range; and an input interface configured to:

receive from said user an instruction to start said repetition of said mechanical vibrations;

stand by;

receive from said user a frequency scanning stop-instruction to stop said repetition of said mechanical vibrations when a stationary frequency corresponding to a current frequency of said mechanical vibrations is achieved at which said user perceives a decrease of said tinnitus;

notify to said microcontroller a frequency value corresponding to said stationary frequency; and continue generating said mechanical vibrations at said stationary frequency;

wherein said microcontroller is configured to cause said repetition of said mechanical vibrations at an intensity lower than or equal to an audibility threshold, wherein said microcontroller is configured to change said mechanical vibrations emitted by said electromechanical vibrator within an intensity range between −20 dB HL and 20 dB HL, and wherein said microcontroller is configured to preliminarily cause said electromechanical vibrator to carry out said change of said mechanical vibrations by:

emitting said mechanical vibrations at an intensity at most 10% higher than an audibility threshold, during an acclimation time after said instruction to start generating said mechanical vibrations; and reducing said intensity to a value lower than said audibility threshold after said acclimation time;

wherein said microcontroller continues to deliver a multisensory stimulation to said user by way of said mechanical vibrations at said intensity value lower than said audibility threshold.

2. The stimulation system according to claim 1, wherein said microcontroller is configured to carry out a step of fine tuning of said frequency of said mechanical vibrations upon receiving said frequency scanning stop-instruction, said step of fine tuning comprising repeating said mechanical vibrations at frequencies about a frequency of one of said mechanical vibrations being generated when receiving said frequency scanning stop-instruction.

3. The stimulation system according to claim 1, wherein said microcontroller is configured to carry out an intensity adjustment of said mechanical vibrations upon receiving said frequency scanning stop-instruction at said stationary frequency.

4. The stimulation system according to claim 2, wherein said microcontroller is configured to carry out an intensity adjustment of said mechanical vibrations at the end of said step of fine tuning of said frequency.

5. The stimulation system according to claim 3, wherein said microcontroller is configured to carry out a step of fine tuning of said intensity of said mechanical vibrations after receiving said frequency scanning stop-instruction and after said intensity adjustment of said mechanical vibrations.

6. The stimulation system according to claim 1, wherein said microcontroller is configured to modify the intensity of said mechanical vibrations such that said user can modify said intensity if no decreases of said tinnitus symptoms at the end of said mechanical vibrations are perceived.

7. The stimulation system according to claim 1, wherein said electromechanical vibrator is programmed for automatically transmitting mechanical vibrations at predetermined time intervals.

8. The stimulation system according to claim 1, wherein said electromechanical vibrator is selected among a voice coil type actuator and a piezoelectric actuator.

9. The stimulation system according to claim 1, wherein said microcontroller is configured to carry out a step of adjusting the waveform of said mechanical vibrations.

10. The stimulation system according to claim 1, wherein said adhesive application device further configured for removably receiving said electromechanical vibrator.

11. The stimulation system according to claim 10, wherein said adhesive application device is configured for being adhesively applied to said tissues.

12. The stimulation system according to claim 1, wherein said microcontroller is configured to carry out a step of fine tuning of said intensity of said mechanical vibrations after receiving said frequency scanning stop-instruction.

* * * * *